US008093475B1

(12) United States Patent
Sperzel

(10) Patent No.: US 8,093,475 B1
(45) Date of Patent: Jan. 10, 2012

(54) TUNING DEVICE

(76) Inventor: Robert J. Sperzel, North Ridgeville, OH (US)

( * ) Notice: Subject to any disclaimer, the term of this patent is extended or adjusted under 35 U.S.C. 154(b) by 0 days.

(21) Appl. No.: 12/899,096

(22) Filed: Oct. 6, 2010

(51) Int. Cl.
*G10D 3/14* (2006.01)

(52) U.S. Cl. ..... 84/312 R

(58) Field of Classification Search ..... 84/312 R, 84/304–306

See application file for complete search history.

(56) References Cited

U.S. PATENT DOCUMENTS

| | | | | |
|---|---|---|---|---|
| 1,295,215 | A | 2/1919 | Schermerhorn | |
| 1,811,738 | A | 6/1931 | Williams | |
| 2,557,877 | A | 6/1951 | Kluson | |
| 4,377,963 | A | 3/1983 | Siminoff | |
| 4,589,321 | A | 5/1986 | Pritchard | |
| 5,847,295 | A * | 12/1998 | Klepacki | 84/305 |
| 6,078,001 | A | 6/2000 | Kang | |
| 6,580,022 | B2 | 6/2003 | Kang | |
| 7,217,876 | B2 | 5/2007 | Allen et al. | |
| 2006/0117929 | A1 | 6/2006 | Gotoh | |

* cited by examiner

*Primary Examiner* — Kimberly Lockett
(74) *Attorney, Agent, or Firm* — Tarolli, Sundheim, Covell & Tummino LLP

(57) ABSTRACT

A device for use in tuning a string of a musical instrument includes a pinion gear which is connected with a rotatable shaft. A worm gear is rotated to effect rotation of the pinion gear and shaft about a central axis of the shaft. A sleeve encloses a portion of the shaft and is rotatable relative to the shaft. The sleeve includes string holes which are alignable with string holes in the shaft. The shaft has recesses formed at end portions of the string holes in the shaft. The sleeve extends across and encloses the recesses formed in the shaft. The sleeve and shaft are relatively rotatable from a first spatial relationship in which the string holes in the sleeve are aligned with the string hole in the shaft and a second spatial relationship in which the string holes in the sleeve are offset from the string hole in the shaft. Knurling is provided on the outside of the sleeve.

19 Claims, 6 Drawing Sheets

TUNING DEVICE

BACKGROUND OF THE INVENTION

The present invention relates to a tuning device and more specifically to a tuning device for use in tuning a string of a stringed musical instrument.

There are many known tuning devices for use in tuning the string of a musical instrument. Some of these known tuning devices are disclosed in U.S. Pat. Nos. 1,295,215; 1,811,738; 2,557,877; 4,377,963; 4,589,321; and 6,078,001. Of course, there are many other known tuning devices for use in association with stringed musical instruments of many different types.

Regardless of the specific construction of the tuning device, once a tuning device has been used to obtain a desired tension in the string of a musical instrument, it is important that this tension is maintained as the musical instrument is played. In order to maintain a desired tension in a string of a musical instrument, it is necessary for the tuning device to obtain and maintain a secure grip on the string. Although the string may have any one of many different known constructions, the strings of musical instruments are commonly made of either metal or polymeric material. It has been suggested that the string of a musical instrument may be made of a combination of metal and polymeric materials.

SUMMARY OF THE INVENTION

The present invention relates to a new and improved device for use in tuning a string of a stringed musical instrument. The tuning device includes a pinion gear which is connected with a shaft. A worm gear is disposed in meshing engagement with the pinion gear. A knob or button may be utilized to rotate the worm gear to effect rotation of the pinion gear and shaft.

In accordance with one of the features of the present invention, a sleeve encloses a portion of the shaft and is rotatable relative to the shaft. The portion of the shaft enclosed by the sleeve includes a string hole which extends through the shaft and is alignable with string holes in the sleeve. Knurling may advantageously be provided on the sleeve. The knurling is engaged by a string to retard sliding of the string relative to an outer side of the sleeve.

In accordance with another feature of the present invention, recesses may be formed in the shaft at end portions of the string hole in the shaft. The recesses may be enclosed by the sleeve. The sleeve and shaft are relatively rotatable to a first spatial relationship in which the string holes in the sleeve are aligned with the string hole in the shaft. The sleeve and shaft are relatively rotatable to a second spatial relationship in which the string holes in the sleeve are spaced from a spatial envelope containing the inner side surface of the string hole in the shaft.

A tuning device constructed in accordance with the present invention has many different features. These features may be utilized together as disclosed herein, or may be used separately. For example, the knurling on the sleeve may be omitted. As another example, the knurled sleeve may be utilized without providing recesses in the shaft. Of course, tuning devices constructed in accordance with the present invention may have combinations of features which are different from the combinations previously set forth herein.

BRIEF DESCRIPTION OF THE DRAWINGS

The foregoing and other features of the present invention will become more apparent upon a consideration of the following description taken in connection with the accompanying drawings wherein.

DESCRIPTION OF SPECIFIC PREFERRED EMBODIMENTS OF THE INVENTION

A stringed musical instrument 20 (FIG. 1) has strings 22 which are tuned with tuning devices 24 which are constructed in accordance with the present invention. The stringed musical instrument 20 may be a violin, cello, viola, banjo, ukulele, guitar, or similar instrument. However, the illustrated stringed musical instrument 20 is a guitar.

Figure 1:
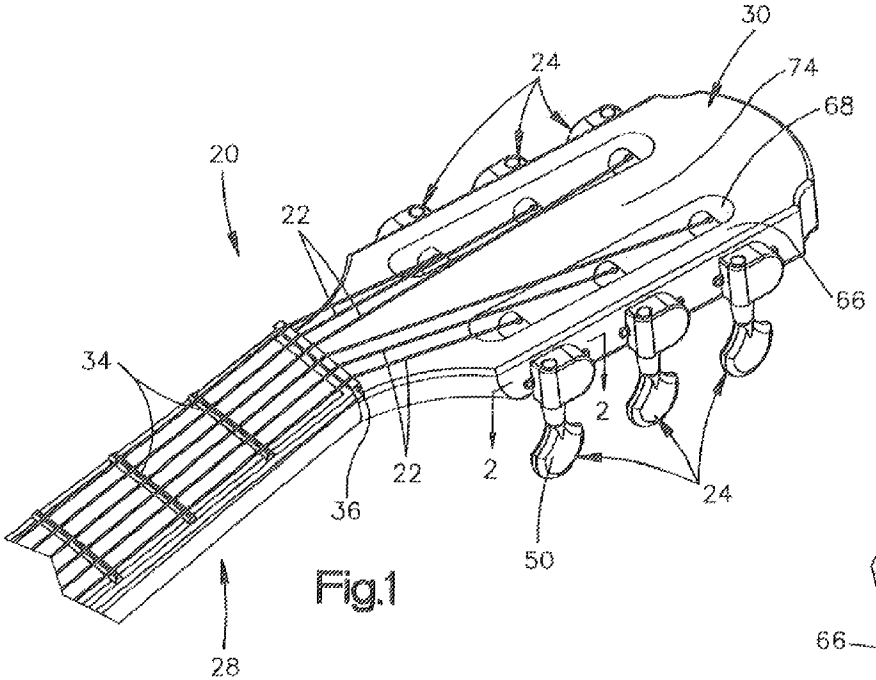
FIG. 1 is a fragmentary schematic pictorial illustration of the head stock and neck of a musical instrument having tuning devices constructed in accordance with the present invention.

The stringed musical instrument 20 may be an acoustic guitar, electric guitar, or an electric acoustic guitar. The specific stringed musical instrument 20 illustrated in FIG. 1 is a classical acoustic guitar. However, tuning devices 24 constructed in accordance with the present invention may be utilized in stringed musical instruments other than classical acoustic guitars.

The classical guitar 20 has a well known construction and includes a neck 28 which is connected with a body (not shown) in a known manner. The tuning devices 24 are mounted on a head stock 30 which forms part of the neck 28. The strings 22 extend along the neck 28 between the tuning devices 24 and a bridge (not shown) disposed on the body of the guitar. The strings 22 extend across frets 34 and a nut 36 disposed on the neck 28 of the guitar.

The strings 22 may have any desired composition and construction. It is contemplated that the strings 22 may be formed of a natural or synthetic polymeric material. If the strings 22 are formed of a synthetic polymeric material, the material may be nylon. Alternatively, the strings 22 may be formed of a natural polymeric material, such as gut. If desired, the strings may have a core of one material and an over winding of another material. Although it is believed that nylon or gut strings 22 may be selected for use in the guitar 20, the strings may be formed of metal if desired.

It should be understood that the stringed musical instrument 20 and head stock 30 may have a construction other than the construction illustrated in FIG. 1. For example, the stringed musical instrument 20 and head stock 30 may have a construction similar to the construction disclosed in U.S. Pat. No. 6,444,886. The construction of the musical instrument 20 and strings 22 will depend upon which of many known instruments the tuning device 24 is to be used.

The tuning device 24 includes a rotatable string post or shaft 42 (FIG. 2) which is connected with a string 22 of the stringed musical instrument 20. A pinion gear 44 is connected with an end portion 46 of the shaft 42. A rotatable worm gear 48 is disposed in meshing engagement with the pinion gear 44. The worm gear 48 has a central axis which extends perpendicular to and is offset to one side of a central axis 54 of the shaft 42.

A manually rotatable knob or button 50 is connected to the worm gear. The knob or button 50 may be manually rotated to effect rotation of the worm gear 48. Rotation of the worm gear 48 drives the pinion gear 44 to rotate the shaft 42 about the longitudinal central axis 54 of the shaft.

A housing 60 (FIG. 2) encloses a portion of the shaft 42, pinion gear 44, and worm gear 48. The housing 60 may have a construction similar to the construction disclosed in U.S. Design Pat. No. 256,471. The shaft 42 is rotatably connected with the housing 60 in the manner disclosed in U.S. Pat. No. 4,353,280. Of course, the housing 60 may have a construction which is different than the aforementioned construction and be connected with the shaft 42 in a manner which is different than the aforementioned manner of connection.

Figure 2:
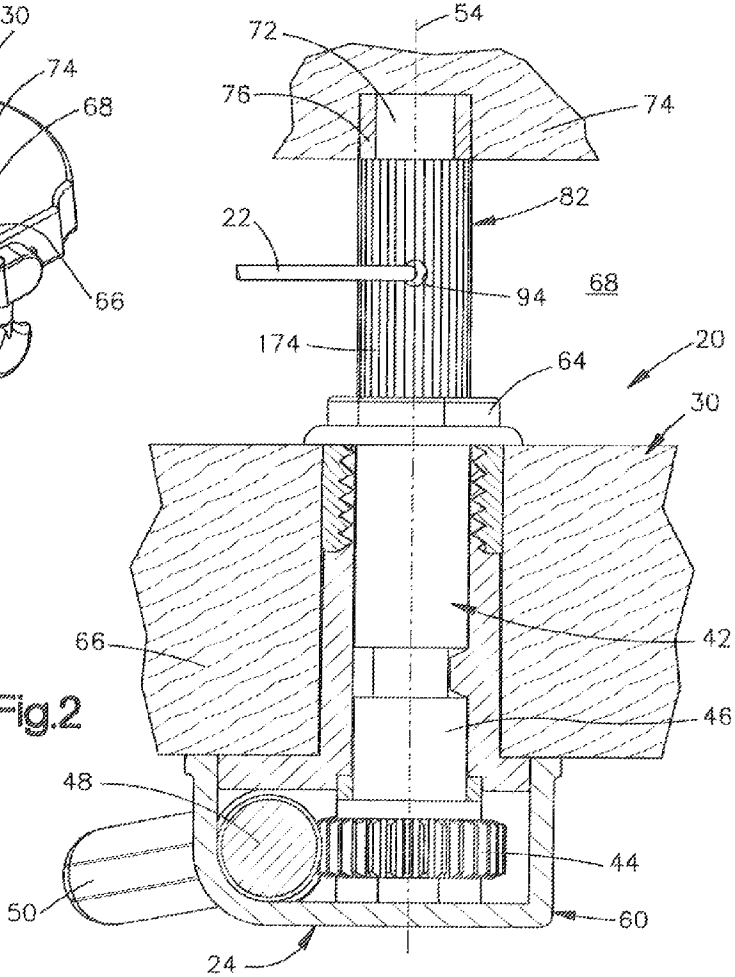
FIG. 2 is a fragmentary sectional view, taken generally along the line 2-2 of FIG. 1 further illustrating the construction of one of the tuning devices used with the musical instrument of FIG. 1.

An internally threaded nut 64 (FIG. 2) cooperates with an external thread on the housing 60 to connect the housing to an outer portion 66 of the head stock 30. The shaft 42 extends across a slot or space 68 formed in the head stock 30 (FIGS. 1 and 2). An outer end portion 72 (FIG. 2) of the shaft 42 is mounted on an inner portion 74 of the head stock 30. In the illustrated embodiment, the cylindrical outer end portion 72 of the shaft 42 is rotatably held by a stationary bearing or bushing 76. However, it should be understood that the shaft 42 may be mounted on the head stock 30 in a different manner if desired.

When the strings 22 are tightened, by use of the tuning devices 24, the strings may tend to slip relative to the tuning devices. In addition, after the tuning devices 24 have been utilized to tighten the strings 22 to a desired tension, the strings may tend to stretch with playing of the stringed musical instrument 20. In addition, the strings 22 may tend to slip relative to the tuning devices 24 during playing of the musical instrument 20 and vibration of the strings.

In accordance with one of the features of the present invention, a sleeve 82 (FIGS. 2-5) is provided around a portion of the shaft 42. In accordance with another feature of the present invention, recesses 86 and 88 (FIGS. 3-5) are formed in the shaft 42 adjacent to opposite ends of a string hole 90 formed in the shaft 42. The sleeves 82 and recesses 86 and 88 on the shafts 42 of the tuning devices 24 cooperate to firmly grip the strings 22 to prevent slippage of the strings relative to the tuning devices. The secure grip provided by the cooperation between the sleeve 82 and recesses 86 and 88 may be found to be particularly advantageous when the strings 22 are formed of a synthetic or natural polymeric material, such as nylon or gut. However, the strings 22 may be formed of metal.

Figure 4:
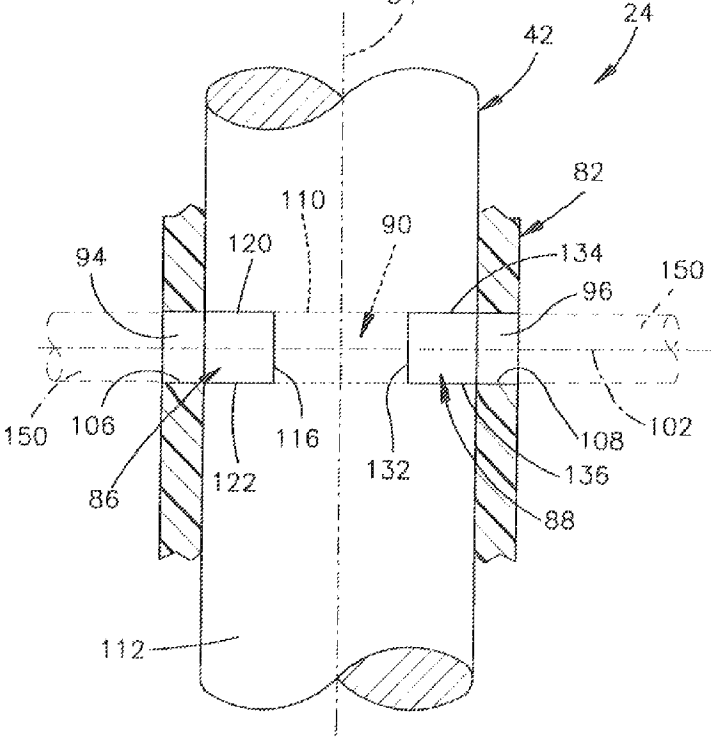
FIG. 4 is a fragmentary sectional view, generally similar to FIG. 3, taken along the line 4-4 of FIG. 3.
Figure 5:
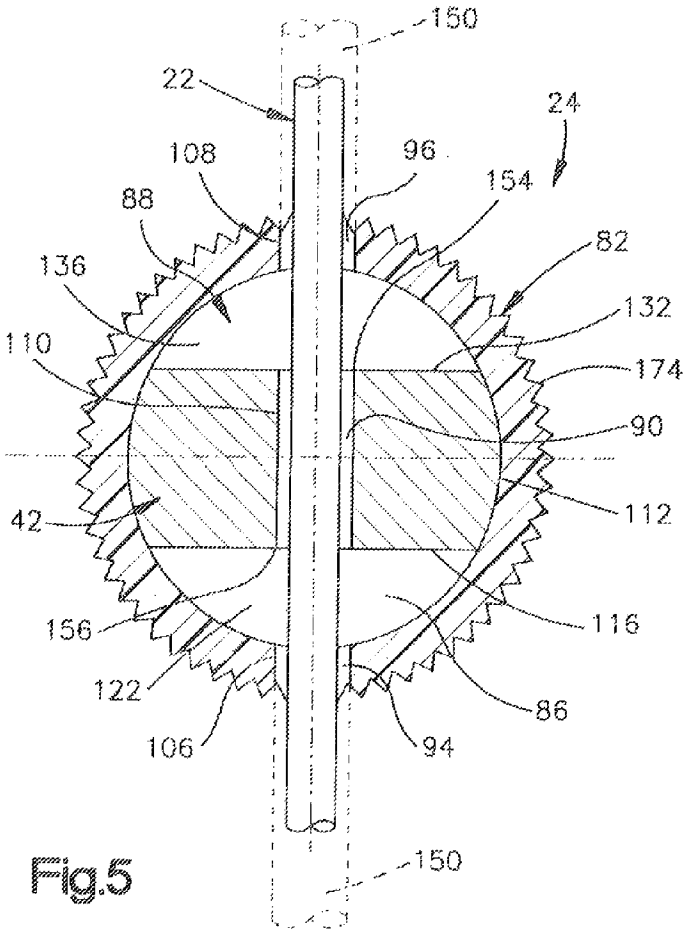
FIG. 5 is a sectional view, taken generally along the line 5-5 of FIG. 3, illustrating the relationship of the sleeve and string post to the string of the musical instrument of FIG. 1.

The string 22 extends through a cylindrical string hole 90 in the cylindrical shaft 42 and through a pair of cylindrical string holes 94 and 96 (FIGS. 4-7) formed in the sleeve 82. The tubular sleeve 82 extends around the portion of the cylindrical shaft 42 in which the recesses 86 and 88 are formed and in which the string hole 90 is formed (see FIGS. 3-5). When the cylindrical sleeve 82 and cylindrical shaft 42 are in a first or initial spatial relationship, the string holes 94 and 96 in the sleeve 82 and the string hole 90 in the shaft 42 are axially aligned (FIGS. 4 and 5). Upon relative rotation between the sleeve 82 and the shaft 42 to another spatial relationship, the string holes 94 and 96 in the sleeve 82 and the string hole 90 in the shaft 42 move out of their aligned condition (see FIGS. 6 and 7).

The cylindrical string hole 90 in the shaft 42 has a longitudinal central axis 102 (FIG. 4) which extends perpendicular to and intersects the longitudinally central axis 54 of the cylindrical shaft 42. When the cylindrical string holes 94 and 96 in the sleeve 82 are aligned with the cylindrical string hole 90 in the shaft 42 (FIGS. 4 and 5), central axes of the string holes 94 and 96 are coincident with the central axis 102 (FIG. 4) of the string hole 90 in the shaft 42. The cylindrical string holes 94 and 96 in the sleeve have the same diameter as the cylindrical string hole 90 in the shaft 42. If desired, the string holes 94 and 96 in the sleeve 82 may have a diameter which is different than the diameter of the string hole 90 in the shaft 42. Opposite ends of the string hole 90 in the shaft 42 may be slightly chamfered.

Upon manual actuation of the knob or button 50 (FIGS. 1 and 2) and operation of the tuning device 24, the shaft 42 and sleeve 82 are rotated relative to each other. The string holes 94 and 96 in the sleeve 82 and the string hole 90 in shaft 42 move to nonaligned conditions, similar to the nonaligned conditions illustrated in FIGS. 6 and 7. Continued manual actuation of the knob or button 50 results in the shaft 42 and sleeve 82 being rotated together without relative rotation between the shaft and sleeve.

The string hole 90 in the shaft 42 and the string holes 94 and 96 in the sleeve 82 have the same diameter (FIGS. 4 and 5). The string holes 94 and 96 are located on diametrically opposite sides of the sleeve 82 so that cylindrical side surfaces 106 and 108 of the string holes 94 and 96 can be aligned with a cylindrical side surface 110 of the string hole 90 in the shaft 42. Of course, the string holes 90, 94, and 96 in the shaft 42 and sleeve 82 have a diameter which is greater than the diameter of the generally cylindrical string 22 (FIG. 5).

It is contemplated that the recesses 86 and 88 may have many different sizes and/or configurations. Although the recesses 86 and 88 are the same size and have the same configuration, it is contemplated that the size and/or configuration of the recess 86 may be different than the size and/or configuration of the recess 88. Both of the recesses 86 and 88 have a depth, as measured along the central axis 102 (FIG. 4) of the string hole 90 in the shaft 42, which is greater than the diameter of the string 22 and is greater than the diameter of the string hole in the shaft. Regardless of the selected size and configuration of the recesses 86 and 88, it is contemplated that they will extend from opposite end portions of the string hole 90 (FIG. 4) to a cylindrical peripheral side surface 112 of the shaft 42.

Figure 3:
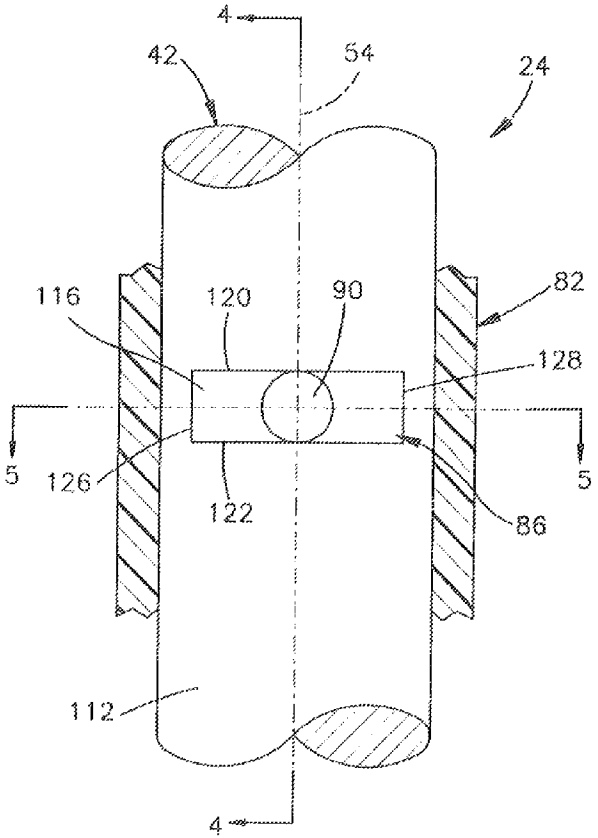
FIG. 3 is a fragmentary sectional view illustrating the relationship of a string hole and recess in a shaft of the tuning device of FIG. 2 to a sleeve.

The specific recess 86 illustrated in FIGS. 3-5 has a flat rectangular bottom surface 116. The bottom surface 116 extends from an end portion of the string hole 90 in the shaft 42 to the peripheral surface 112 of the shaft along a chord to the cylindrical side surface 112 of the shaft 42. The bottom surface 116 of the recess 86 is spaced from the peripheral surface 112 of the shaft 42 by a maximum distance, as measured along the central axis 102 of the string hole 90, which is greater than the diameter of the string hole 90 in the shaft and is greater than the diameter of the string 22.

The bottom surface 116 of the recess 86 extends perpendicular to and intersects the central axis 102 of the string hole 90 in the shaft 42. The bottom surface 116 has a rectangular configuration, as viewed in FIG. 3. One end, that is, the left end (as viewed in FIG. 4), of the string hole 90 is disposed in the plane of the bottom surface 116. If desired, the bottom surface 116 may have an arcuate configuration. If the bottom surface 116 is arcuate, it may have either a concave or a convex configuration.

In addition to the bottom surface 116, the recess 86 has a pair of parallel side surfaces 120 and 122. The flat side surfaces 120 and 122 of the recess 86 extend perpendicular to the bottom surface 116. If desired, the flat side surfaces 120 and 122 may have an arcuately bowed configuration. For example, the side surfaces 120 and 122 may be tangent to one end of the string hole 90 and bow outwardly away from each other toward opposite ends of the recess 86.

The identical side surfaces 120 and 122 of the recess 86 are formed as portions of a circle and are spaced apart by distance which is only slightly greater than the diameter of the string hole 90 in the shaft 42. The side surfaces 120 and 122 extend outward from the bottom surface 116, along the central axis 102 of the string hole 90 in the shaft 42, for a distance which is greater than the diameter of the string hole 90. The bottom surface 116 of the recess 86 intersects the cylindrical outer side surface 112 of the shaft 42 along a pair of parallel linear lines 126 and 128 (FIG. 3) of intersection which extend parallel to the central axis 54 of the shaft 42.

Although only the recess 86 is illustrated in FIG. 3, it should be understood that the recess 88 is identical to the recess 86. The recess 88 has the same size and configuration as the recess 86. Thus, the recess 88 has a flat bottom surface 132 (FIGS. 4 and 5) which extends parallel to the flat bottom surface 116 of the recess 86. The flat bottom surface 132 of the recess 88 intersects the cylindrical side surface 112 of the shaft in the same manner as in which the bottom surface 116 intersects the cylindrical side surface 112 of the shaft 42. In addition, the recess 88 has a pair of flat parallel side surfaces 134 and 136. The side surfaces 134 and 136 of the recess 88 extend perpendicular to the bottom surface 132 of the recess 88 and are disposed in a coplanar relationship with the side surfaces 120 and 122 of the recess 86 (FIG. 4).

Although it is believed that it may be desired to form the recesses 86 and 88 with the same size and configuration, it is contemplated that the recess 88 may have a size and/or configuration which is different than the size and/or configuration of the recess 86. The side surfaces 120 and 122 of the recess 86 and the side surfaces 134 and 136 of the recess 88 are spaced apart by the same distance which is at least as great as the diameters of the circular string holes 94 and 96 in the sleeve 82 and the string hole 90 in the shaft 42. The recesses 86 and 88 may be formed with a circular configuration. If this is done, both recesses 86 and 88 may be formed with a conical configuration if desired. As another example, the recesses 86 and 88 may be formed with oval configurations and have centers which are offset from the central axis 102 of the string hole 90 in the shaft 42.

When a string 22 is to be connected with the tuning device 24 (FIG. 2), the sleeve 82 and/or shaft 42 are rotated until the string holes 94 and 96 in the sleeve are in alignment with the string hole 90 in the shaft. At this time, the central axis 102 (FIG. 4) of the string hole 90 in the shaft 42 will be coincident with central axes of the string holes 94 and 96 in the sleeve 82. In addition, a cylindrical spatial envelope 150 (FIGS. 4 and 5) containing the side surface 110 of the string hole 90 in the shaft 42 will also contain the side surfaces 106 and 108 of the string holes 94 and 96 in the sleeve 82. The cylindrical spatial envelope 150 has a diameter which is greater than the diameter of the string 22 and is the same as the diameter of the string hole 90.

It should be understood that the string hole 90 in the shaft 42 may have a size and/or configuration which is different than the size and/or configuration of the string holes 94 and 96 in the sleeve 82. For example, rather than having cylindrical configurations, the string holes 94 and 96 in the sleeve 82 may be formed as portions of cones. If this is done, the relatively large diameter end portions of the cones would face outward away from the shaft 42 while the relatively small diameter end portions of the cones would face inwardly toward the shaft 42. This configuration would facilitate threading of a string 22 through the string holes 94 and 96 in the sleeve 82 into the string hole 90 in the shaft 42. If this is done, the relatively small diameter inner end portions of the conical string holes 94 and 96 in the sleeve 82 may have diameters equal to or slightly larger than the diameter of the string hole 90 in the shaft 42.

After the sleeve 82 and/or the shaft 42 have been rotated to position the string holes 94 and 96 in the sleeve in alignment with the string hole 90 in the shaft, in the manner illustrated schematically in FIGS. 4 and 5, the string 22 is inserted through one of the two string holes 94 or 96 in the sleeve 82, through the string hole 90 in the shaft 42 and through the other string hole in the sleeve. This results in a straight portion of the string 22 extending through the string hole 90 in the shaft 42 and through the string holes 94 and 96 in the sleeve 82 (FIG. 5). At this time, the straight portion of the string is disposed within the cylindrical spatial envelope 150 which contains the cylindrical side surfaces 106 and 108 of the string holes 94 and 96 in the sleeve 82 and the cylindrical side surface 110 of the string hole 90 in the shaft 42.

The end portion of the string 22 opposite from the tuning device 24 (FIG. 2) is connected with a bridge on the body of the stringed musical instrument 20. If desired, a vibrato arm or tremolo bar may be attached to the bridge to slacken or tighten the strings temporarily to thereby change the pitch. However, since the illustrated stringed instrument is a classical acoustical guitar, the vibrato arm or tremolo bar will probably be omitted. Of course, if the stringed musical instrument 20 is an electrical guitar, which may be of the "Stratocaster" (Trademark) style, a vibrato arm or tremolo bar may be provided.

The end portion of the string 22 opposite from the bridge and extending through the sleeve 82 and shaft 42, that is, the lower end portion as viewed in FIG. 5, may be manually pulled to initially tighten the string. Thus, the string 22 may be manually pulled downward (as viewed in FIG. 5). As this occurs, the string 22 will deflect or bend toward the right (as viewed in FIGS. 5 and 6) under the influence of tension in the portion of the string disposed between the bridge (not shown) and tuning device 24. As this occurs, the string 22 applies force to the sleeve 82. This force is effective to rotate the sleeve in a clockwise (as viewed in FIG. 5) direction relative to the stationary shaft 42. This results in the sleeve 82 rotating, relative to the shaft 42, from the position shown in FIG. 5 toward the position shown in FIG. 6 under the influence of force applied to the sleeve by the string 22.

Figure 6:
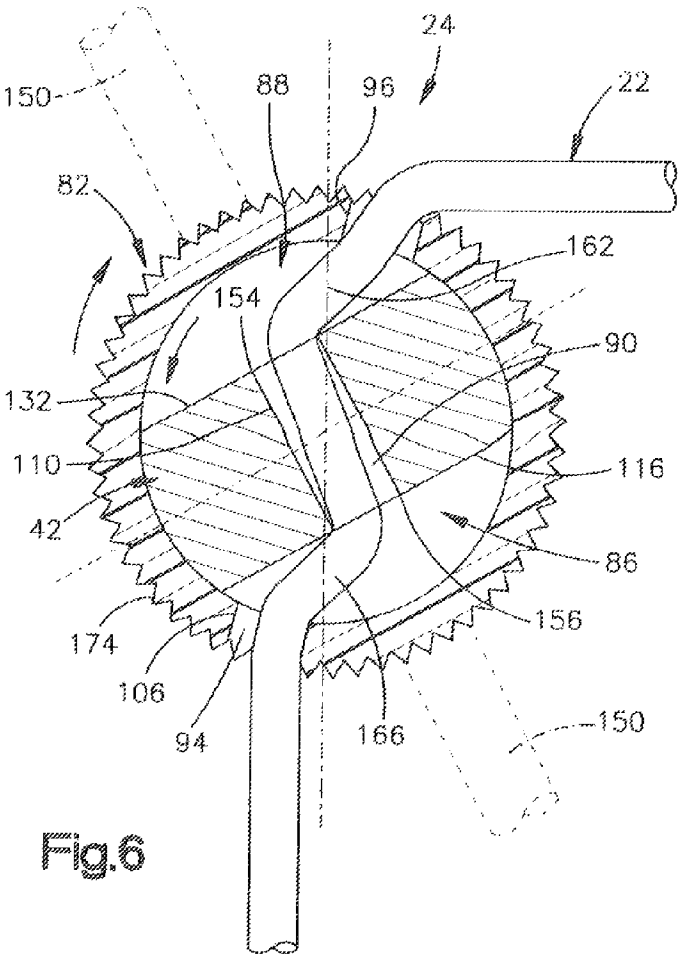
FIG. 6 is a sectional view, generally similar to FIG. 5, illustrating the relationship between the string post and sleeve during initial rotation of the string post relative to the sleeve.

As the string 22 is manually pulled and deflected toward the position shown in FIG. 6, the string is pressed against a peripheral portion 154 of the string hole 90. The illustrated peripheral portion 154 of the string hole 90 is formed by a circular upper (as viewed in FIGS. 5 and 6) corner of the string hole 90. The string 22 is deflected toward the right (as viewed in FIG. 5) by engagement with the upper corner 154 of the string hole 90. The illustrated corner 154 (FIG. 5) is a sharp right angle corner. However, the corner 154 may be rounded if desired.

At the same time, the manually tightened lower portion of the string is pressed against a peripheral portion 156 of the string hole 90. The illustrated peripheral portion 156 of the string hole 90 is formed by a lower circular corner 156 of the string hole 90. The illustrated corner 156 (FIG. 5) is a sharp right angle corner. However, the corner 156 may be rounded if desired.

Continued tensioning of the string, by manually pulling on the lower (as viewed in FIG. 5) end portion of the string, causes the string to bend at the corners 154 and 156 of the string hole 90. At the same time, the string holes 94 and 96 in the sleeve 82 are displaced in a clockwise direction (as viewed in FIG. 5) about the central axis of the stationary shaft 42. This results in the sleeve 82 rotating from the position shown in FIG. 5 toward the position shown in FIG. 6 relative to the stationary shaft 42.

As the lower (as viewed in FIG. 5) portion of the string 22 is manually pulled, the upper (as viewed in FIG. 5) portion of the string is tensioned by pulling on the bridge of the guitar 20. The string 22 is pulled downward (as viewed in FIG. 5) through the string hole 90 in the stationary shaft 42 and the string holes 94 and 96 in the sleeve 82. This initial manual tightening of the string 22 is effective to rotate the sleeve 82 relative to the stationary shaft 42 and to take up at least some of the slack in the string.

As the string 22 continues to be manually tightened, the string is deflected toward the condition illustrated schematically in FIG. 6. This is accomplished by bending of the string at the locations where the string engages the corners 154 and 156 at opposite ends of the string hole 90 in the stationary shaft 42.

As the string 22 is manually pulled from the initial condition illustrated schematically in FIG. 5, the sleeve 82 rotates in a clockwise direction (as viewed in FIG. 5) relative to the stationary shaft 42. The sleeve 82 is rotated relative to the shaft 42 by force transmitted from the string 22 to the sleeve at corners of the string holes 94 and 96 in the sleeve. As this occurs, the distance between the corner 154 at the upper (as viewed in FIG. 5) end of the string hole 90 in the shaft 42 and the string hole 96 in the sleeve 82 increases. This results in sliding movement of the string 22 relative to the string hole 96 in the sleeve. Of course, even more sliding movement of the string 22 relative to the string hole 96 in the sleeve 82 is caused by elimination of slack in the string.

Once the string 22 has been manually tightened by pulling on the lower (as viewed in FIG. 5) portion of the string, the tuning device 24 is manually actuated by rotating the knob or button 50 (FIG. 2). This causes counterclockwise (as viewed in FIG. 5) rotation of the shaft 42. As this occurs, the shaft 42 moves from the position illustrated in FIG. 5 toward the position illustrated in FIG. 6. As the shaft 42 moves toward the position illustrated in FIG. 6, the force transmitted through the string 22 to the bridge of the guitar 20 pulls on the string.

As the string 22 is tensioned by rotation of the shaft 42, the string is deflected, in the manner illustrated schematically in FIG. 6, by engagement with the corners 154 and 156 of the string hole 90. At the same time, force is applied by the string against the inner and outer corners of the string hole 96 in the sleeve 82. The sleeve 82 rotates, in a clockwise direction (as viewed in FIGS. 5 and 6) relative to the shaft 42, under the influence of force applied to the sleeve by the string 22. As this occurs, the portion of the string 22 which spans the recess 88 (FIG. 5) is deflected in a clockwise direction (as viewed in FIG. 6) toward the bottom surface 132 of the recess 88. Force transmitted between the string 22 and the sleeve 82 causes the string to be urged toward the bottom surface 132 of the recess 88.

Figure 7:
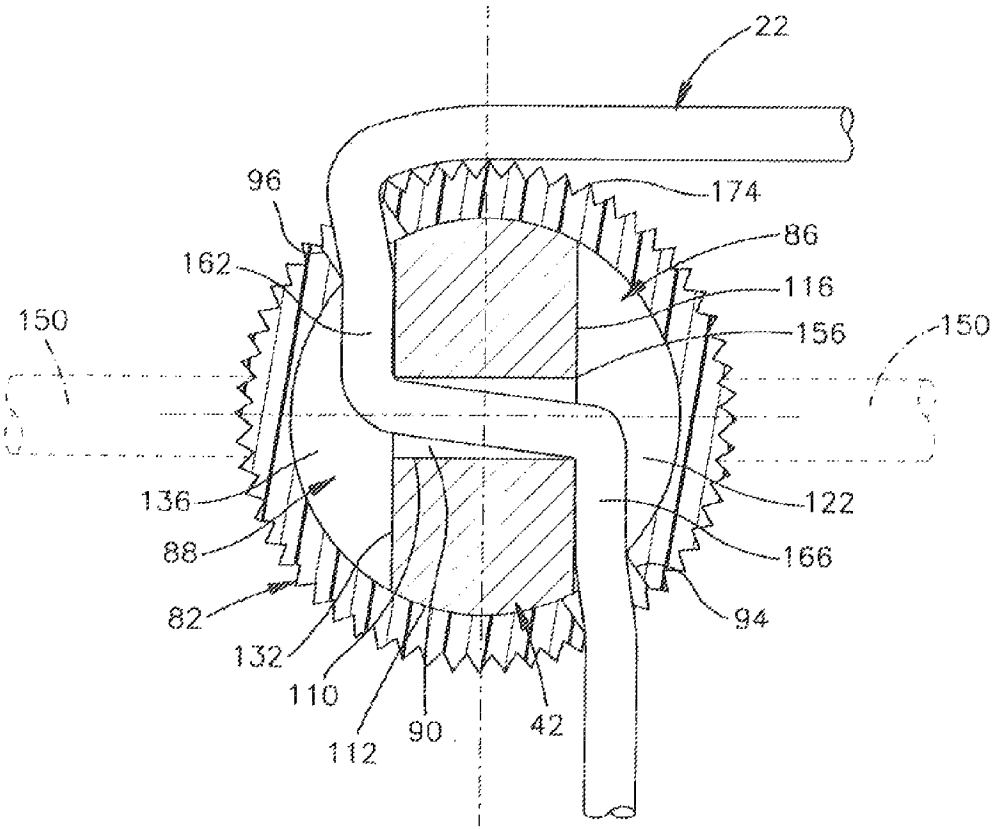
FIG. 7 is a sectional view, further illustrating the relationship between the string post and sleeve after continued rotation of the string post from the position illustrated in FIG. 6.

As the shaft 42 continues to be rotated in a counterclockwise direction (as viewed in FIGS. 5-7) by actuation of the tuning device 24, the force applied against the left (as viewed in FIGS. 6 and 7) side of the string 22 by the sleeve 82 is effective to press a portion, indicated at 162 in FIGS. 6 and 7, of the string against the bottom surface 132 of the recess 88. The sleeve 82 presses the string 22 against the bottom surface 132 of the recess 88 at a location spaced from the intersection between the bottom surface of the recess and the outer side surface 112 of the shaft 42.

The bottom surface 132 of the recess 88 cooperates with the sleeve 82 to grip the string with a holding action. Any tendency for the sleeve 82 and shaft 42 to cut the string 22 with a shearing action is minimized. This is accomplished by having the portion 162 of the string 22 pressed against the bottom surface 132 of the recess 88 by the sleeve 82. The portion 162 of the string 22 is pressed against the bottom surface of the recess 88 at a location between the corner 154 of the string hole 90 in the shaft 42 and the intersection of the bottom surface 132 and the outer side surface 112 of the shaft.

As the portion 162 of the string 22 is gripped between the sleeve 82 and bottom surface 132 of the recess 88 in the shaft 42 (FIG. 7), a lower (as viewed in FIG. 7) portion 166 of the string 22 is pressed against the bottom surface 116 of the recess 86 by the sleeve 82. This results in the string 22 being clamped against the bottom surfaces 116 and 132 of both the recesses 86 and 88 by the sleeve 82.

In addition to being clamped against the bottom surfaces 116 and 132 of the recesses 86 and 88, the string is bent around the corner portions 154 and 156 of the string hole 90 in the shaft 42. The combined effect of bending the string 22 around the corner portions 154 and 156 of the string hole 90 in the shaft 42 and gripping the portions 162 and 166 of the string 22 between the sleeve 82 and the bottoms 132 and 116 of the recesses 86 and 88 is to securely grip the string and hold it against sliding movement relative to the shaft 42. Therefore, there is no slippage of the string 22 relative to the shaft 42 even though the string is formed of a material having a smooth outer side surface which tends to slide relative to the shaft. It is believed that this combined clamping and bending action to hold the string 22 against movement relative to the shaft 42 will be particularly advantageous if the string is formed of a natural or synthetic polymeric material, such as gut or nylon. Of course, the same gripping action would be obtained if the string 22 is formed of a material other than a synthetic or natural polymer. For example, the string 22 may be formed of metal.

As the manual actuation of the tuning device 24 is continued by rotation of the knob 50, shaft 42 and sleeve 82 rotate together from the position illustrated in FIG. 6 through the position illustrated in FIG. 7. As this rotation continues a plurality of turns or wraps of the string 22 are formed around the sleeve 82 and shaft 42. At the same time, tension in the portion of the string extending between the tuning device 24 and the bridge of the guitar increases. It should be understood that even though less than a complete turn or wrap of the string 22 around the sleeve 82 and shaft 42 is illustrated in FIG. 2, a plurality of turns or wraps of the string 22 are formed around the sleeve 82.

As the tension in the string 22 increases, the sleeve 82 and shaft 42 cooperate in such a manner as to even more firmly grip the portions 162 and 166 of the string. By having the portions 162 and 166 of the string 22 gripped against the bottom surfaces 116 and 132 of the recesses 86 and 88, the gripping force is applied against a relatively large area of the string. This minimizes any tendency for the string 22 to be damaged and weakened by an indenting and/or cutting action between the shaft 42 and sleeve 82. This enables the tension to be maintained in the string 22 during playing of the guitar 20.

In accordance with another feature of the invention, knurling 174 (FIGS. 2 and 5) is provided on the outside of the sleeve 82 to improve the gripping action between the sleeve and the string 22. Thus, as the shaft 42 is rotated from the position illustrated in FIG. 6 through the position illustrated in FIG. 7, the knurling 174 is engaged by the string 22. The knurling 174 increases the gripping action between the sleeve 82 and the string 22.

The knurling 174 is formed by a series of small ridges or beads on the surface of the sleeve 82. In the illustrated embodiment of the invention, the knurling 174 is formed by a series of longitudinally extending ridges. The series of longitudinally extending ridges extends completely around the sleeve 82. Each of the ridges forming the knurling 174 has a relatively sharp crest and trough to provide a firm gripping action with the string 22. The ridges forming the knurling extend between axially opposite ends of the sleeve 82 and have longitudinal central axes which extend parallel to the coincident longitudinal central axes 54 of the sleeve 82 and shaft 42.

The knurling 174 may be formed by protuberances other than the illustrated series of longitudinally extending ridges. For example, the knurling may have a diamond shaped (criss-cross) pattern. If desired, the knurling may be formed by a combination of diamond shaped beads or protuberances and ridges. The ridges may be circular and/or linear.

In the illustrated embodiment of the sleeve 82, the ridges forming knurling 174 extend between axially opposite ends of the sleeve. However, radially projecting annular collars could be formed at axially opposite ends of the sleeve 82. If this was done, the knurling 174 would extend between the collars. It should be understood that a plurality of circular wraps of the string 22 are formed around the knurled portion of the sleeve 82.

The sleeve 82 is advantageously formed of a material which is softer than the material forming the shaft 42. In the illustrated embodiment of the invention, the shaft 42 is formed of metal, such as brass or steel. The sleeve 82 is formed of a polymeric material in which the ridges forming the knurling 174 are molded. By forming the sleeve 82 of a relatively soft material, compared to the shaft 42, any tendency for the sleeve 82 and shaft 42 to cut or otherwise damage the string 22 is minimized. This is because the material of the sleeve 82 will yield, to some extent, as the sleeve is pressed against the string 22.

Although the sleeve 82 is advantageously formed of a relatively soft polymeric material, it is contemplated that the sleeve may be formed of a different material if desired. For example, the sleeve 82 may be formed of metal. Alternatively, the sleeve 82 may be formed of both metal and polymeric material. If this was done, the polymeric material which forms portions of the sleeve 82 would engage the string 22 while the metal may form the portions of the sleeve which would engage the shaft 42. If desired, suitable bearing material may be disposed on the portion of the sleeve formed of metal. This bearing material would engage the shaft 42.

Figure 8:
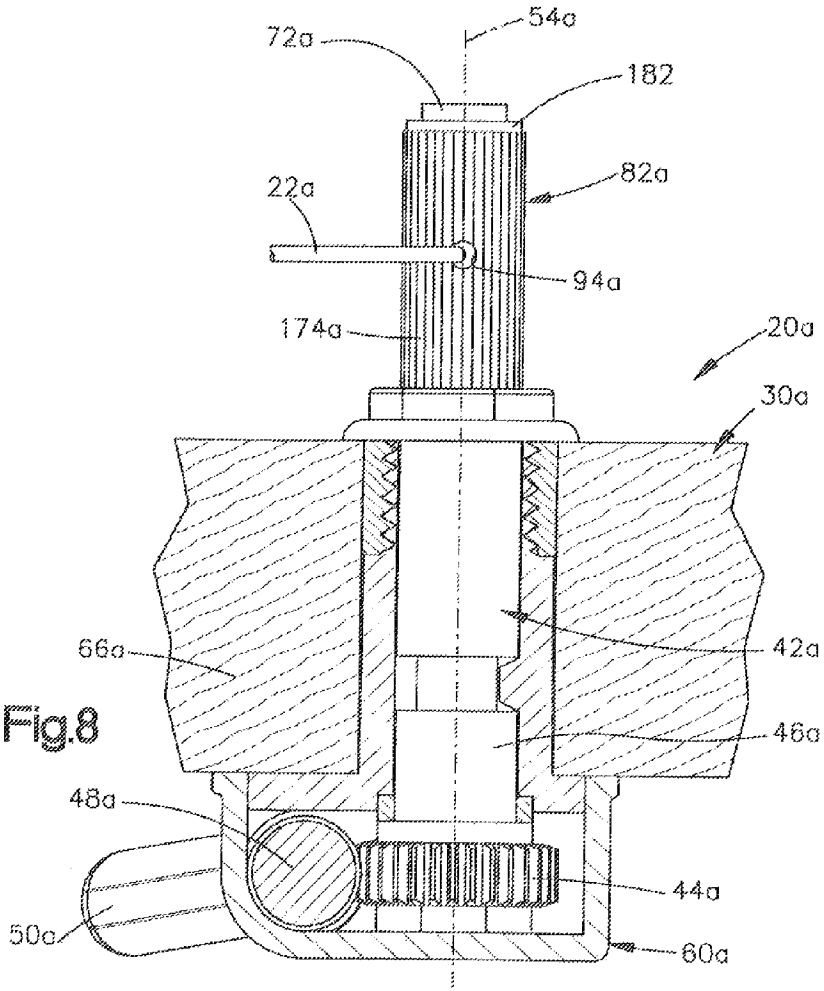
FIG. 8 is a fragmentary sectional view, generally similar to FIG. 2, illustrating a second embodiment of the tuning device.

In the embodiment of the invention illustrated in FIGS. 1-7, the shaft 42 has an outer end portion 72 (FIG. 2) which is supported by an inner portion 74 (FIG. 1) of the stringed musical instrument. In the embodiment of the invention illustrated in FIG. 8, the outer end portion of the shaft is not supported. Since the embodiment of the invention illustrated in FIG. 8 is generally similar to the embodiment of the invention illustrated in FIGS. 1-7, similar numerals will be utilized to identify similar components. The suffix letter "a" being associated with the numerals of FIG. 8 to avoid confusion.

A tuning device 24*a* is used on a stringed musical instrument 20*a* to adjust the tension in a string 22*a* of the musical instrument. The musical instrument 20*a* may be of the acoustic, electric, or the electric acoustic type. The specific musical instrument 20*a* with which the tuning device 24*a* is associated may be a classical guitar with a tuning device disposed in the orientation illustrated in U.S. Pat. No. 7,217,876 or U.S. Pat. No. 4,696,219. Alternatively, the musical instrument may be a guitar having tuning devices oriented as shown in U.S. Pat. No. 6,444,886. It should be understood that the tuning device 24*a* may be used on stringed musical instruments other than a guitar. For example, the tuning device 24*a* may be used on a violin, cello, viola, banjo, or ukulele.

The tuning device 24*a* includes a shaft 42*a* having an end portion 46*a* connected to a pinion gear 44*a*. The pinion gear 44*a* is disposed in meshing engagement with a worm gear 48*a*. A knob or button 50*a* is manually rotatable to turn the worm gear 48*a* about its longitudinal central axis. Rotation of the worm gear 48*a* effects rotation of the pinion gear 44*a* and shaft 42*a* about the longitudinal central axis 54*a* of the shaft 42*a*. The worm gear 48*a*, pinion gear 44*a* and shaft 42*a* are at least partially enclosed by a housing 60*a*.

In accordance with one of the features of the present invention, the outer or upper (as viewed in FIG. 8) end portion 72*a* of the shaft 42*a* extends for only a short distance past the sleeve 82*a*. A circular clip or retainer 182 engages an annular groove in the end portion 72*a* of the shaft 42*a* to retain the sleeve 82*a* on the shaft. Of course, the sleeve 82*a* could be retained in a different manner if desired. For example, an annular flange may be provided on the end portion 72*a* of the shaft 42*a*.

When the shaft 42*a* has the configuration illustrated in FIG. 8, the tuning device 24*a* may be mounted in any desired orientation relative to the head stock 30 (FIG. 1) of a guitar or other stringed musical instrument 20. This enables the tuning device 24*a* to be utilized on a classical guitar and mounted in the orientation illustrated in U.S. Pat. No. 7,217,876. Alternatively, the tuning device 24*a* may be mounted in the orientation disclosed in U.S. Pat. No. 5,962,797.

Figure 9:
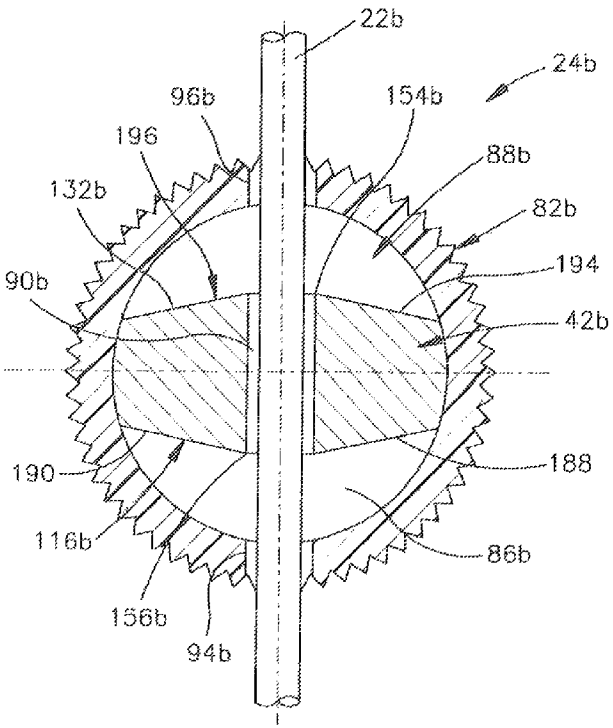
FIG. 9 is a sectional view, generally similar to FIG. 5, illustrating the construction of another embodiment of the tuning device.

In the embodiment of the invention illustrated in FIGS. 1-7, the bottom surfaces 116 and 132 of the recesses 86 and 88 extend perpendicular to a longitudinal central axis of the string 22 (FIG. 5). In the embodiment of the invention illustrated in FIG. 9, the bottom surfaces of the recesses are skewed at an acute angle to the longitudinal central axis of the string. Since the embodiment of the invention illustrated in FIG. 9 is generally similar to the embodiment of the invention illustrated in FIGS. 1-7, similar numerals will be utilized to identify similar components. The suffix letter "b" being associated with the numerals of FIG. 9 to avoid confusion.

A tuning device 24*b* (FIG. 9) has the same general construction as the tuning device 24 of FIG. 2 and the tuning device 24*a* of FIG. 8. The tuning device 24*b* includes a string hole 90*b* through which a string 22*b* extends. The shaft 42*b* is partially surrounded by a sleeve 82*b* having string holes 94*b* and 96*b*. The manner in which the sleeve 82*b*, string 22*b* and post 42*b* cooperate with each other is the same as was previously described in conjunction with the embodiment of the invention illustrated in FIGS. 1-7.

In accordance with a feature of the embodiment of the invention illustrated in FIG. 9, the recesses 86*b* and 88*b* have bottom surfaces 116*b* and 132*b* which extend at acute angles relative to the longitudinally central axis of the string 22*b*. In the embodiment of the invention illustrated in FIGS. 1-7, the bottom surfaces 116 and 132 of the recesses 86 and 88 extend parallel to each other, in the manner illustrated in FIGS. 4 and 5. In the embodiment of the invention illustrated in FIG. 9, the portion of the bottom surface 116*b* disposed to the right of the string 22*b* and designated by the numeral 188 in FIG. 9 extends transverse to the portion 190 of the bottom surface 116*b* and disposed to the left (as viewed in FIG. 9) of the string 22*b*. This results in the circular corner 156*b* having an included angle which is less than 90 degrees. The resulting relatively sharp corner 156*b* can more easily obtain a secure grip on the string 22*b* than can be obtained with the corner 156 of FIG. 5 which has an included angle of 90 degrees.

Similarly, the portion 194 of the bottom surface 132*b* disposed to the right (as viewed in FIG. 9) of the string 22*b* skewed relative to a portion 196 of the bottom surface 132*b* disposed to the left (as viewed in FIG. 9) of the string 22*b*. This results in a circular corner 154*b* at the upper (as viewed in FIG. 9) end of the string hole 90*b* in the shaft 42*b* having an included angle which is less than 90 degrees.

In the embodiment of the invention illustrated in FIG. 5, the bottom surfaces 116 and 132 of the recesses 86 and 88 extend parallel to each other. In the embodiment of the invention illustrated in FIG. 9, the portions 188 and 194 of the bottom surfaces 116*b* and 132*b* disposed to the right of the string 22*b* are skewed at an acute angle relative to each other. Similarly, the portions 190 and 196 of the bottom surfaces 116*b* and 132*b* of the recesses 86*b* and 88*b* disposed to the left (as viewed in FIG. 9) of the string 22*b* are skewed relative to each other.

Figure 10:
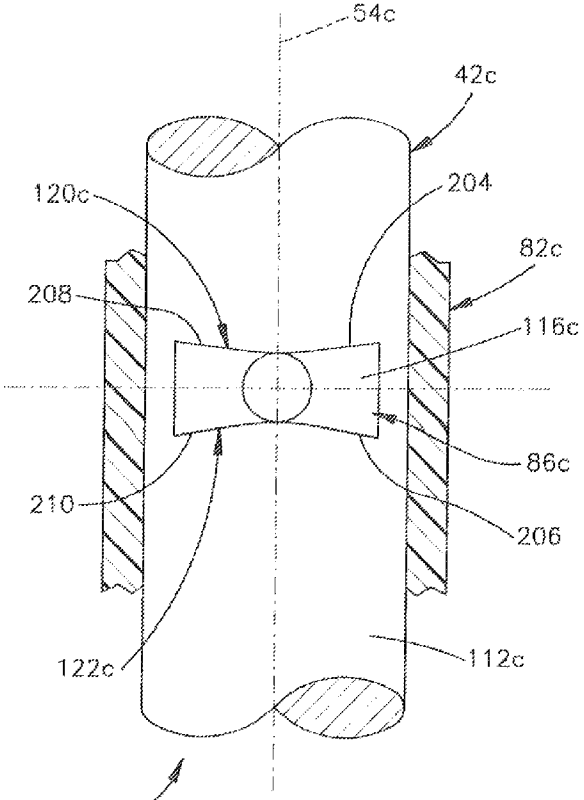
FIG. 10 is a sectional view, generally similar to FIG. 3, illustrating another embodiment of the tuning device.

In the embodiment of the invention illustrated in FIGS. 1-7, the side surfaces 120 and 122 (FIG. 4) of the recess 86 extend parallel to each other. Similarly, the side surfaces 134 and 136 of the recess 88 extend parallel to each other. In the embodiment of the invention illustrated in FIG. 10, the recesses in the shaft are provided with side surfaces having portions which extend at acute angles relative to each other. Since the embodiment of the invention illustrated in FIG. 10 is generally similar to the embodiment of the invention illustrated in FIGS. 1-7, similar numerals will be utilized to identify similar components. The suffix letter "c" being associated with the numerals of FIG. 10.

A tuning device 24*c* includes a shaft 42*c* which is partially enclosed by a cylindrical sleeve 82*c*. a string hole 90*c* extends diametrically through the shaft 42*c*. The string holes (not shown) are provided in the sleeve 82*c* and are movable into alignment with the string hole 90*c* in the shaft 42*c*. The string holes in the cylindrical sleeve 82*c* have the same construction and configuration as the string holes 94 and 96 in the sleeve 82 of FIGS. 2-7. A string, not shown but corresponding to the string 22 of FIGS. 5-7, may extend through the string hole 90*c* in the cylindrical shaft 42*c* and through the string holes in the sleeve 82*c* in the manner illustrated schematically in FIGS. 5-7 for the string 22. Although only a portion of the tuning device 24*c* is illustrated in FIG. 10 it should be understood that the tuning device 24*c* has the same general construction as the tuning device 24 and cooperates with a string in the same manner as previously described in conjunction with the embodiment of the invention illustrated in FIGS. 1-7.

In accordance with one of the features of the embodiment of the invention illustrated in FIG. 10, the recess 86*c* in the shaft 42*c* is provided with side surfaces which, along at least a portion of the length, are skewed at an acute angle relative to a central axis 54*c* of the shaft 42*c*. The side surfaces 120*c* and 122*c* include right (as viewed in FIG. 10) portions 204 and 206 which flare outwardly away from each other. The portions 204 and 206 of the side surfaces 120*c* and 122*c* flare outward so that a flat bottom surface 116*c* of the recess 86*c* intersects an outer side surface 112*c* of the shaft 42*c* at a location where the distance between the portions 204 and 206 of the side surface 120*c* is a maximum. The portions 204 and 206 of the side surfaces 120*c* and 122*c* extend perpendicular to the bottom surface 116*c* of the recess 82*c*.

Similarly, left portions 208 and 210 of the side surfaces 120*c* and 122*c* diverge at acute angles away from each other and away from the string hole 90*c* in the shaft 42*c*. The distance between the portions 208 and 210 of the side surfaces 120*c* and 122*c* is a minimum adjacent to the string hole 90*c*. The distance between the portions 208 and 210 of the side surfaces 120*c* and 122*c* is a maximum where the flat bottom surface 116*c* of the recess 86*c* intersects the cylindrical outer side surface 112*c* of the shaft 42*c*. The portions 208 and 210 of the side surfaces 120*c* and 122*c* extend perpendicular to the bottom surface 116*c* of the recess 86*c*.

Although only the recess 86*c* is illustrated in FIG. 10, it should be understood that a second recess is disposed in a diametrically opposite portion of the cylindrical shaft 42*c*. The second recess in the shaft 42*c*, that is, the recess corresponding to the recess 88 in FIGS. 4-7, has the same configuration as the recess 86*c*. If desired, the recesses in the shaft 42*c* may have a different configuration. For example, the portions 204-210 of the side surfaces 120*c* and 122*c* may have an arcuate configuration. If desired, the bottom surface 116*c* of the recess 86*c* may have a configuration similar to the configuration of the bottom surface 116*b* (FIG. 9) of the recesses.

CONCLUSION

In view of the foregoing description, it is apparent that the present invention provides a new and improved device 24 for use in tuning a string 22 of a stringed musical instrument 20. The tuning device 24 includes a pinion gear 44 which is connected with a shaft 42. A worm gear 48 is disposed in meshing engagement with the pinion gear 44. A knob or button may be utilized to rotate the worm gear 48 to effect rotation of the pinion gear and shaft 42.

In accordance with one of the features of the present invention, a sleeve 82 encloses a portion of the shaft 42 and is rotatable relative to the shaft. The portion of the shaft 42 enclosed by the sleeve 82 includes a string hole 90 which extends through the shaft and is alignable with string holes 94 and 96 in the sleeve. Knurling 174 may advantageously be provided on the sleeve 82. The knurling 174 is engaged by a string 22 to retard sliding of the string relative to an outer side of the sleeve 82.

In accordance with another feature of the present invention, recesses 86 and 88 may be formed in the shaft 42 at end portions 154 and 156 of the string hole 90 in the shaft. The recesses 86 and 88 may be enclosed by the sleeve. The sleeve 82 and shaft 42 are relatively rotatable to a first spatial relationship in which the string holes 94 and 96 in the sleeve are aligned with the string hole 90 in the shaft 42. The sleeve 82 and shaft 42 are relatively rotatable to a second spatial relationship in which the string holes 94 and 96 in the sleeve are spaced from a spatial envelope 150 containing the inner side surface 110 of the string hole 90 in the shaft 42.

A tuning device constructed in accordance with the present invention has many different features. These features may be utilized together as disclosed herein, or may be used separately. For example, the knurling 174 on the sleeve 82 may be omitted. As another example, the knurled sleeve 82 may be utilized without providing recesses 86 and 88 in the shaft 42. Of course, tuning devices 24 constructed in accordance with the present invention may have combinations of features which are different from the combinations previously set forth herein.

Having described the invention, the following is claimed:

1. A device for use in tuning a string of a stringed musical instrument, said device comprising a rotatable shaft adapted to be connected with a string of the musical instrument, a pinion gear connected with said shaft for rotation therewith about a central axis of said shaft, a rotatable worm gear disposed in meshing engagement with said pinion gear, means for rotating said worm gear to effect rotation of said pinion gear and shaft about the central axis of said shaft, and a sleeve enclosing a portion of said shaft and rotatable relative to said shaft, said portion of said shaft enclosed by said sleeve includes a string hole which extends through said shaft and is alignable with first and second string holes in said sleeve to enable a portion of the string of the musical instrument to extend through the string hole in said shaft and through the first and second string holes in said sleeve, said shaft having a first recess formed in said shaft at a first end portion of the string hole in said shaft, said shaft having a second recess formed in said shaft at a second end portion of the string hole in said shaft, said sleeve extends across and encloses said first and second recesses formed in said shaft, said first recess in said shaft having a surface which extends from a peripheral portion of the string hole in said shaft at said first end portion of the string hole in said shaft to a side surface of said shaft at a location enclosed by said sleeve and spaced from a spatial envelope containing an inner side surface of the string hole in said shaft, said second recess in said shaft having a surface which extends from a peripheral portion of the string hole in said shaft at the second end portion of the string hole in said shaft to the side surface of said shaft at a location enclosed by said sleeve and spaced from the spatial envelope containing the inner side surface of the string hole in said shaft, said sleeve and shaft being relatively rotatable from a first spatial relationship to a second spatial relationship, said first string hole in said sleeve being aligned with the first end portion of the string hole in said shaft and said second string hole in said sleeve being aligned with the second end portion of the string hole in said shaft when said sleeve and shaft are in the first spatial relationship, said first string hole in said sleeve is spaced from the spatial envelope containing the inner side surface of the string hole in said shaft and said second string hole in said sleeve is spaced from the spatial envelope containing the inner side surface of the string hole in said shaft when said sleeve and shaft are in the second spatial relationship, said first and second string holes in said sleeve extend around portions of the string which are spaced fromthe spatial envelope containing the inner side surface of the string hole in said shaft when said sleeve and shaft are in the second spatial relationship, said first and second recesses in said shaft receive portions of the string when said sleeve and shaft are in the second spatial relationship.

2. A device as set forth in claim 1 wherein said surfaces of said first and second recesses are spaced from the string when said sleeve and shaft are in the first spatial relationship, said surface of at least one of said first and second recesses is disposed in engagement with the string when said sleeve and shaft are in the second spatial relationship.

3. A device as set forth in claim 1 wherein said surface of said first recess in said shaft includes a first bottom surface, said surface of said second recess in said shaft includes a second bottom surface, said first recess in said shaft includes spaced apart side surfaces which intersect said first bottom surface and said side surface of said shaft, said second recess in said shaft includes spaced apart side surfaces which intersect said second bottom surface and said side surface of said shaft, the portion of the string received in the first recess when said sleeve and shaft are in the second spatial relationship is at least partially disposed between said spaced apart side surfaces of the first recess, the portion of the string received in the second recess when said sleeve and shaft are in the second spatial relationship is at least partially disposed between said spaced apart side surfaces of the second recess.

4. A device as set forth in claim 1 wherein said string hole in said shaft has a circular configuration, said first and second recesses formed in said shaft each have an extent along a longitudinal central axis of said shaft which is at least as great as diameter of the string.

5. A device as set forth in claim 4 wherein said string holes in said sleeve have a circular configuration and diameters which are the same as the diameter of said string hole in said shaft.

6. A device as set forth in claim 1 wherein said sleeve has a cylindrical inner side surface which is disposed in engagement with said side surface of said shaft, said cylindrical inner side surface of said sleeve extends across and blocks the spatial envelope containing the inner side surface of the string hole in said shaft when said sleeve and shaft are in the second spatial relationship.

7. A device as set forth in claim 1 wherein said sleeve is rotatable in a first direction relative to said shaft under the influence of force transmitted from the string to said sleeve during rotation of said shaft in a second direction which is opposite to said first direction.

8. A device as set forth in claim 1 wherein said sleeve includes knurling which extends around an outer side of said sleeve and is engaged by the string to retard sliding of the string relative to the outer side of said sleeve.

9. A device as set forth in claim 8 wherein said knurling includes a series of ridges which extends around said sleeve and has crests which are engaged by the string.

10. A device as set forth in claim 1 wherein said surface of said first recess includes a first flat bottom surface which intersects a cylindrical side surface of said shaft at locations disposed on opposite sides of the string hole in said shaft, said surface of said second recess includes a second flat bottom surface which intersects the cylindrical of said surface of said shaft at locations disposed on opposite sides of the string hole in said shaft, said second flat bottom surface extends parallel to said first flat bottom surface, said first recess in said shaft includes parallel side surfaces which extend perpendicular to said first flat bottom surface, said second recess in said shaft includes parallel side surfaces which extend perpendicular to said second flat bottom surface.

11. A device as set forth in claim 10 wherein said parallel side surfaces of the first recess are spaced apart by a distance which is at least as great as a diameter of a cylindrical inner side surface of the string hole in said shaft, said parallel side surfaces of the second recess are spaced apart by a distance which is at least as great as the diameter of the cylindrical inner side surface of the string hole in said shaft.

12. A device as set forth in claim 1 wherein said pinion gear is connected to a first end portion of said shaft, said shaft having a second end portion which is disposed axially outward of said sleeve and has a cylindrical bearing surface which is engagable with and rotatable relative to a bearing surface connected with the musical instrument.

13. A device as set forth in claim 1 wherein said pinion gear is connected to a first end portion of said shaft, said shaft has a second end portion opposite from said first end portion, said second end portion includes and a retainer which is disposed on said second end portion of said shaft, said retainer being effective to retain said sleeve on said shaft with said sleeve at least partially disposed between said first and second end portions of said shaft.

14. A device as set forth in claim 1 the peripheral portion of the string hole in said shaft at said first end portion of the string hole in said shaft includes a first corner, the peripheral portion of the string hole in said shaft at said second end portion of the string hole in said shaft includes a second corner, said first string hole in said sleeve includes a third corner, said second string hole in said sleeve includes a fourth corner, a first portion of the string engages the first corner at the first end portion of the string hole in said shaft, said surface of said first recess in said shaft, and said third corner at said first string hole in said sleeve when said sleeve and shaft are in the second spatial relationship, a second portion of the string engages the second corner at the second end portion of the string hole in said shaft, said surface of said second recess in said shaft, and said fourth corner at said second string hole in said sleeve when said sleeve and shaft are in the second spatial relationship.

15. A device as set forth in claim 1 wherein said shaft is formed of a material having a first hardness and said sleeve is formed of a material having a second hardness, said second hardness being less than said first hardness to enable at least a portion of said sleeve to be deflected upon relative rotation between said sleeve and shaft from the first condition to the second condition.

16. A device for use in tuning a string of a stringed musical instrument, said device comprising a rotatable shaft adapted to be connected with a string of the musical instrument, a pinion gear connected with said shaft for rotation therewith about a central axis of said shaft, a rotatable worm gear disposed in meshing engagement with said pinion gear, means for rotating said worm gear to effect rotation of said pinion gear and shaft about the central axis of said shaft, and a sleeve enclosing a portion of said shaft and rotatable relative to said shaft, said portion of said shaft enclosed by said sleeve includes a string hole which extends through said shaft and is alignable with first and second string holes in said sleeve, said sleeve and said shaft being engagable with the string to block rotation of the sleeve relative to the shaft during rotation of the shaft, said sleeve having knurling which extends around an outer side of said sleeve and is engaged by the string to retard sliding of the string relative to the outer side of said sleeve.

17. A device as set forth in claim 16 wherein said shaft has a first recess formed in said shaft at a first end portion of the string hole in said shaft, said shaft having a second recess formed in said shaft at a second end portion of the string hole in said shaft, said sleeve extends across and encloses said first and second recesses formed in said shaft.

18. A device as set forth in claim 16 wherein said knurling on said sleeve includes a series of longitudinally extending ribs, each of said ribs of said series of ribs has a longitudinal axis which extends parallel to the central axis of said shaft.

19. A device as set forth in claim 18 wherein said series of longitudinally extending ribs extending completely around said sleeve.

* * * * *